US009341411B2

(12) United States Patent
Carow et al.

(10) Patent No.: US 9,341,411 B2
(45) Date of Patent: May 17, 2016

(54) METHOD FOR DETECTING THE CYCLE TERMINATION OF A HOUSEHOLD TUMBLE DRYER

(71) Applicant: Whirlpool Corporation, Benton Harbor, MI (US)

(72) Inventors: James P. Carow, Saint Joseph, MI (US); Jurij Paderno, Novate Milanese (IT); Paolo Spranzi, Borgosatollo (IT)

(73) Assignee: Whirlpool Corporation, Benton Harbor, MI (US)

( * ) Notice: Subject to any disclaimer, the term of this patent is extended or adjusted under 35 U.S.C. 154(b) by 524 days.

(21) Appl. No.: 13/793,262

(22) Filed: Mar. 11, 2013

(65) Prior Publication Data

US 2013/0276324 A1 Oct. 24, 2013

(30) Foreign Application Priority Data

Apr. 19, 2012 (EP) ..... 12164690

(51) Int. Cl.
*F26B 21/00* (2006.01)
*D06F 58/28* (2006.01)

(52) U.S. Cl.
CPC ..... *F26B 21/00* (2013.01); *D06F 58/28* (2013.01); *D06F 2058/2819* (2013.01); *D06F 2058/2829* (2013.01); *D06F 2058/2835* (2013.01); *D06F 2058/2838* (2013.01); *D06F 2058/2896* (2013.01)

(58) Field of Classification Search
CPC . F26B 21/10; D06F 58/28; D06F 2058/2829; D06F 2058/289; D06F 2058/2893
See application file for complete search history.

(56) References Cited

U.S. PATENT DOCUMENTS

| | | | | |
|---|---|---|---|---|
| 6,122,840 | A | 9/2000 | Chbat et al. | |
| 6,141,887 | A * | 11/2000 | Chen et al. | 34/475 |
| 2011/0308103 | A1 | 12/2011 | Bellinger et al. | |
| 2013/0091728 | A1 * | 4/2013 | Morin et al. | 34/491 |

FOREIGN PATENT DOCUMENTS

| | | | |
|---|---|---|---|
| EP | 1818441 | A1 | 8/2007 |
| EP | 2034086 | A1 | 3/2009 |
| WO | 2011077391 | A2 | 6/2011 |

OTHER PUBLICATIONS

European Search Report for corresponding EP 12164690.5, Sep. 20, 2012.

* cited by examiner

*Primary Examiner* — David J Laux

(57) ABSTRACT

Disclosed are methods for detecting the cycle termination of a household tumble dryer having sensors for measuring at least two different parameters related to the drying process. In an example method for detecting the cycle termination of a household tumble dryer having sensors for measuring at least two different parameters related to a drying process, signals from the sensors are combined according to a predetermined algorithm in order to improve the accuracy of said detection.

11 Claims, 2 Drawing Sheets

METHOD FOR DETECTING THE CYCLE TERMINATION OF A HOUSEHOLD TUMBLE DRYER

RELATED APPLICATION

This application claims the priority benefit of European Patent Application 12164690.5 filed on Apr. 19, 2012, the entirety of which is incorporated herein by reference.

TECHNICAL FIELD

The present disclosure relates to a method for detecting the cycle termination of a household tumble dryer having sensors for measuring at least two different parameters related to the drying process, for instance air temperature and clothes conductivity.

BACKGROUND

In most household tumble dryers, if an automatic cycles is selected, an algorithm chooses the cycle duration based on the signal coming from a sensor measuring a certain parameter, for instance clothes conductivity (by means for instance of metal strips) or air humidity. In other words, the signal coming from the sensor is directly correlated to the moisture content of the clothes, whose value is compared with a threshold to detect the end of the drying cycle.

Unfortunately, this known approach may suffer from several problems. For example, if clothes conductivity parameter is used, the values thereof based on signals coming from the conductivity strips are highly correlated to the water hardness, which may vary from region to region. Moreover, the conductivity value is related to the fabric type and, in case of a synthetic load, a static electricity phenomena (that often appear during the end of the cycle) may interfere with the sensor information.

Further still, the conductivity strips may provide an unreliable signal in case of small loads or in case of bulky items, because the strips simply measure the moisture of the load surface. Similarly, the information coming from air humidity sensor is affected by the accumulation of lint on the sensor surface, which may lead to inaccuracy of measurement due to its position and by occurrence of condensation on the sensor surface.

Methods for automatically detecting end of drying cycle by means of temperature information are also known. Unfortunately, these methods are affected by inaccuracy when customer desires a termination of the cycle with a relatively high remaining moisture content (e.g. to make ironing easier).

For all the above reasons, the performances of end of cycle information coming from a single sensor (e.g., a temperature sensor, a conductivity sensor or a humidity sensor) may lead to under-drying or over-drying of the clothes that respectively means unsatisfied customers, or wasted energy and time together with possible fabric damage.

SUMMARY

It is an object of the present disclosure to provide a method to detect an end of cycle of a drying cycle that can overcome at least the above drawbacks without increasing the overall cost of the appliance and its complexity.

The above object is reached thanks to the features listed in the appended claims.

A method according to the disclosure merges the information coming from different sensors in order to avoid any energy waste and clothes damages.

A method according to the disclosure improves the cycle termination accuracy, avoids damp clothes at end of cycle that means customer dissatisfaction, and avoiding over drying that means energy waste, especially in an area close to the dry bone condition where the energy efficiency is very low.

As described above, a rough estimation of the remaining moisture content (RMC) can be obtained using separately the information coming from each sensor. A simple strategy to use all available sensors and ensure clothes to be dried could be to wait for all the sensors to detect the end of cycle condition before terminating the cycle. However this method would lead in most of the cases to an over drying of the clothes, thus wasting energy, time and damaging the fabrics.

BRIEF DESCRIPTION OF THE FIGURES

Further advantages and features of the present disclosure will become clear from the following detailed description, provided as non limiting examples, with reference to the attached drawings in which.

DETAILED DESCRIPTION

Figure 1:
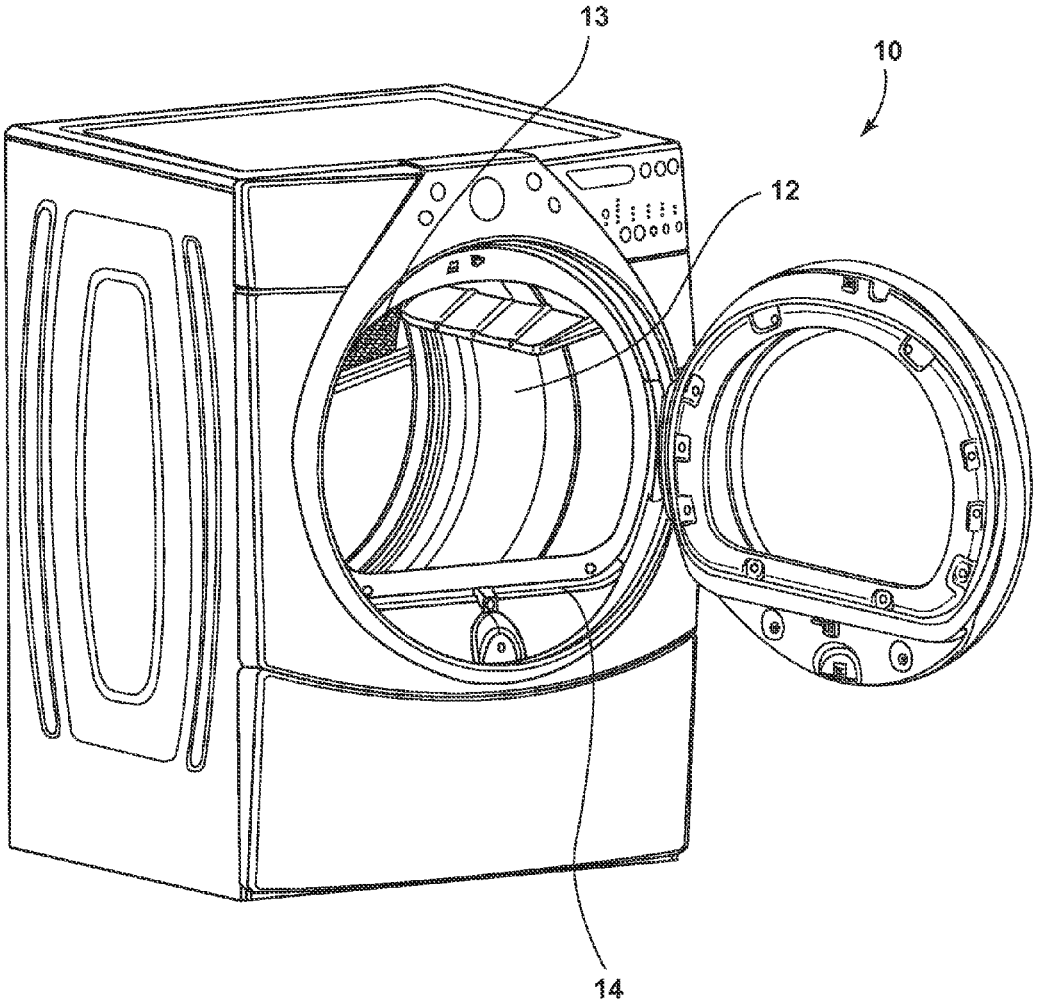
FIG. 1 shows a perspective view of a dryer according to the disclosure.

With reference to FIG. 1, a tumble dryer 10 is composed of a rotating drum 12 actuated by an electric motor (not shown) and containing a certain amount of clothes, a heating system that heats air entering in the drum 12 (e.g., by means of resistors, heat exchangers, etc.), a blower that makes air flow across the drum 12, a temperature sensor that measures the temperature of the air in the process air loop (e.g. at an inlet 13 of the drum 12 or at the drum outlet 14), a temperature sensor measuring the temperature of the heating loop, a conductivity sensor that may be touch with clothes during the drying process, and possibly a humidity sensor placed in the drum 12 or after the drum outlet 14.

In order to accurately detect an end of cycle, disclosed methods rely on an RMC estimate obtained by merging different sensors information. Naming $Cond_{strip}$ the conductivity strip measurement (set equal to 0 if measurement is not available), $Evap_{hum}$ the humidity sensor measurement (set equal to 0 if measurement is not available), $T_{heat}$ and $T_{air}$ the temperature measurements at the inlet 13 and at the outlet of the drum 12, respectively, an estimate $RMC_{est}$ of the RMC of clothes can be obtained as follows:

$$RMC_{est}(k)=\alpha T_{air}+\beta T_{heat}+\gamma RMC_{est}(k-1)+\epsilon Cond_{strip}+\eta Evap_{hum}+\delta$$

in which parameters α, β, γ, ϵ, η and δ are predetermined and constant during the drying process. These parameters can be computed by means of off-line optimization or using process modeling equations.

As an illustrative example, assuming for the sake of simplicity, that the air humidity measurement $Evap_{hum}$ is not available, the above mentioned estimator can be tuned based upon the following simplified model:

$$\dot{RMC} = \frac{\dot{m}_{air} c_{p_{air}} (T_{air} - T_{heat})}{m_{fabric} h_{evap}}$$

$$RMC \approx \mu Cond_{strip}$$

In which $cp_{air}$ is the specific heat capacity of the air, $m_{fabric}$ the mass of the fabric (it could be assumed to be equal to the rated load), $\dot{m}_{air}$ is the design air mass flow rate, $h_{evap}$ is the vaporization enthalpy, and μ is a coefficient identified by testing. In this simple case the coefficients can be set equal to:

$$\alpha = \frac{\dot{m}_{air} c_{p_{air}} T_s}{h_{evap} m_{fabric}}$$

$$\beta = -\alpha$$

$$\gamma = 1 - T_s K$$

$$\epsilon = T_s K \mu$$

$$\eta = \delta = 0$$

in which $T_s$ is the estimator sampling time and K is a parameter that, for example, could be set equal to the Kalman matrix (in this case a constant scalar) found using $Cond_{strip}$ as a measurement and RMC as the process state and process output.

A possible improvement on the accuracy of above mentioned method, especially if measurements are affected by noise, can be obtained using as input of the above equation the already filtered measurements or adding to the previous equation past values of available measurements as follows.

$$RMC_{est}(k)=\alpha T_{air}(k)+\alpha' T_\text{air}(k-1)+\beta T_{heat}(k)+\beta' T_{heat}(k-1)+\gamma RMC_{est}(k-1)$$

A further improvement of the disclosed method can be obtained using variable parameters. An easy interpretation of why the use of variable coefficients can improve estimation performances comes from the fact that it's equivalent to the use of nonlinear physics equations in the model that may describe better the system behavior and/or to the use of nonlinear state observer and/or to noise affecting the measurement that changes with time. The way parameters are modified during the drying process can be a function of time and or of the available measurements and/or of the RMC estimation and/or if available other estimates such as load mass, airflow, fabric temperature, etc.

Figure 2:
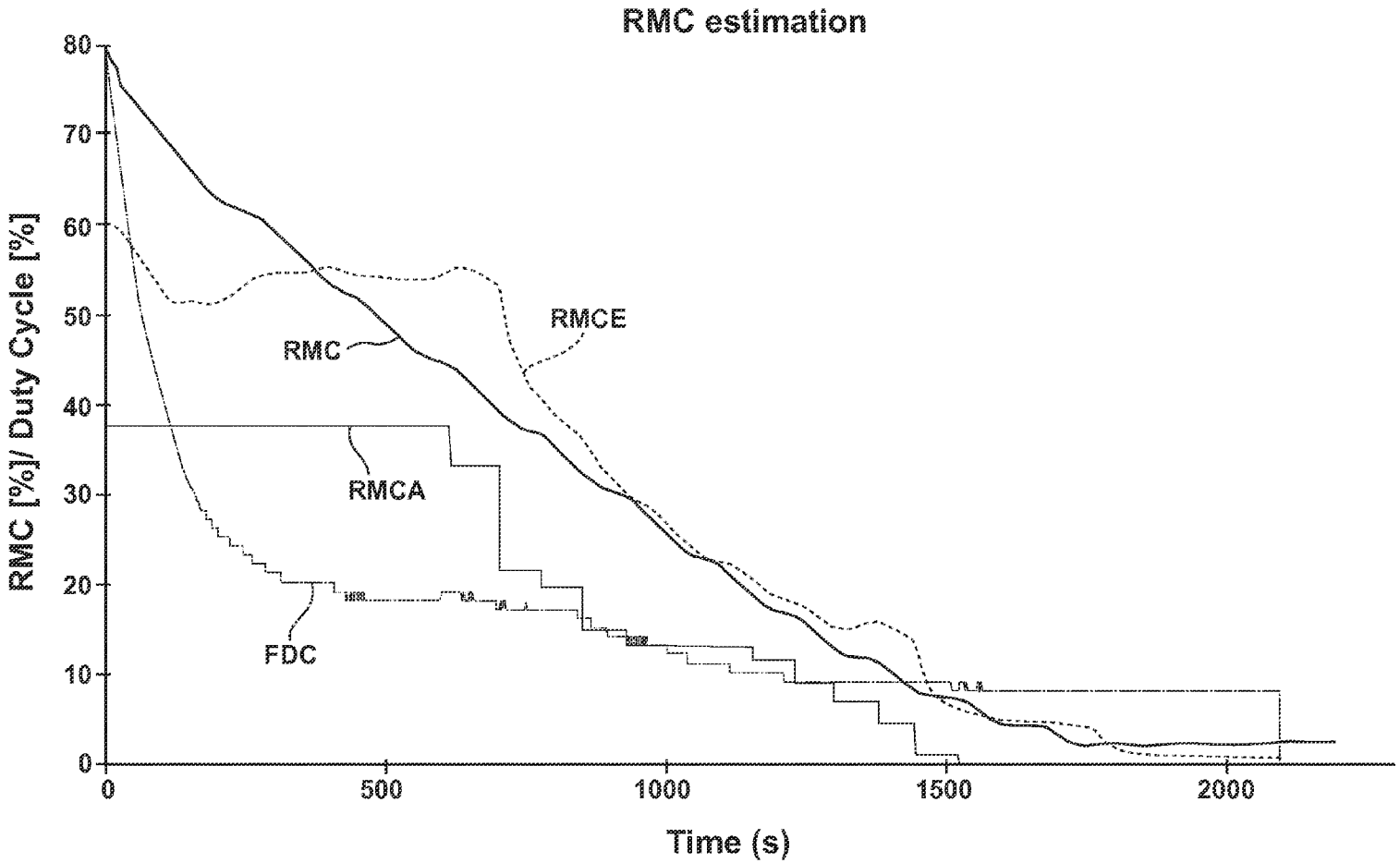
FIG. 2 is a diagram showing how actual RMC and estimated RMC change vs. time.

With reference to FIG. 2, an example of a residual moisture content estimator is the following:

$$RMC_{est}(k)=\alpha\text{Evap Rate}(k)+\beta RMC\text{ activity}(k)+\gamma RMC_{est}(k-1)+\epsilon Cond_{strip}(k)+\delta$$

In this case, the clothes moisture estimation, $RMC_{est}$, is obtained by merging the information coming from the conductivity sensor, filtered DC, the RMC activity (RMCA), and the evaporation rate. The RMCA is based on the relation between the clothes moisture content and the water activity while the evaporation rate is the quantity of water that is steam in a certain amount of time. Both those quantities are computed by means of the temperature signals of drum inlet and outlet as described in the main equation. In the diagram of FIG. 2, the values of those quantities during a real drying process are shown, particularly FDC is filtered DC, RMCA is residual moisture content activity determined through temperature sensors, RMC is the actual residual moisture content and RMCE is the estimated residual moisture content. The estimates are compared with the real RMC coming from the measurement of a scale placed below the dryer. In FIG. 2 it is clear how the RMC estimate according to the disclosure provides values which are pretty close to the actual values, particularly in the last portion of the drying process which is the most critical in terms of assessing the correct termination of the drying process.

The method according to the present disclosure can be used for all kinds of clothes dryers, particularly for air vent dryers, heat-pump dryers, hybrid heat pump dryers, condenser dryers etc.

The invention claimed is:

1. A method for detecting a cycle termination of a household tumble dryer having sensors for measuring at least two different parameters related to a drying process, the method comprising:

determining a remaining moisture threshold for a clothes load based on an automatic cycle selected by a user;

receiving a conductivity strip measurement signal of the conductivity of the clothes load in a dryer drum;

receiving a humidity sensor measurement signal of the humidity level in a drum airflow path;

receiving a signal of the moist air temperature entering the dryer drum;

receiving a signal of the moist air temperature measurement leaving the drum;

combining the signals from the sensors according to a predetermined algorithm to calculate an estimated remaining moisture content of the clothes load to improve the accuracy of the detection; and terminating the drying process when the estimated remaining moisture content is less than or equal to the remaining moisture threshold.

2. The method according to claim 1, wherein the algorithm is based on the following estimate of residual moisture content in the clothes:

$$RMC_est(k)=\alpha T_{air}+\beta T_{heat}+\gamma RMC_est(k-1)+\epsilon Cond_\text{strip}+\eta\text{Evap_hum}+\delta$$

where Cond_strip is a conductivity strip measurement that is set equal to 0 if the conductivity strip measurement is not available, Evap_hum is a humidity sensor measurement that is set equal to 0 if the humidity sensor measurement is not available, $T_{air}$ and $T_{heat}$ are, respectively, the temperature measurements of moist air entering and going out of the drum of the tumble dryer, and α, β, γ, ϵ, η and δ are predetermined constants.

3. The method according to claim 2 wherein at least one of α, β, γ, ϵ, η and δ is a variable parameter.

4. The method according to claim 3 wherein the variable parameter is modified during the drying process as a function of time.

5. The method according to claim 3 wherein the variable parameter is modified during the drying process as a function of the current RMC estimation.

6. The method according to claim 3 wherein the variable parameter is modified during the drying process as a function of load mass.

7. The method according to claim 3 wherein the variable parameter is modified during the drying process as a function of the signal magnitude of at least one signal from the sensors.

8. The method according to claim 1 wherein at least one signal is filtered prior to combining the signals from the sensors.

9. The method according to claim 1 wherein the humidity sensor measurement signal is filtered prior to combining the signals from the sensors.

10. The method according to claim 1 wherein the conductivity strip measurement signal is filtered prior to combining the signals from the sensors.

11. The method according to claim 2 wherein the conductivity strip measurement is filtered.

* * * * *